US011866799B2

(12) United States Patent
Richardson et al.

(10) Patent No.: US 11,866,799 B2
(45) **Date of Patent: *Jan. 9, 2024**

(54) SHAPED BORON TUBULAR STRUCTURE SUPPORT

(71) Applicant: L&W Engineering, New Boston, MI (US)

(72) Inventors: Dean Richardson, Tecumseh, MI (US); Jason Bigelow, New Boston, MI (US)

(73) Assignee: L & W Engineering, New Boston, MI (US)

( * ) Notice: Subject to any disclaimer, the term of this patent is extended or adjusted under 35 U.S.C. 154(b) by 244 days.

This patent is subject to a terminal disclaimer.

(21) Appl. No.: 17/238,451

(22) Filed: Apr. 23, 2021

(65) Prior Publication Data

US 2021/0262054 A1 Aug. 26, 2021

Related U.S. Application Data

(63) Continuation of application No. 15/825,808, filed on Nov. 29, 2017, now Pat. No. 11,021,768.

(60) Provisional application No. 62/428,110, filed on Nov. 30, 2016.

(51) Int. Cl.

| | |
|---|---|
| ***C21D 9/08*** | (2006.01) |
| ***B21D 22/02*** | (2006.01) |
| ***C21D 1/673*** | (2006.01) |
| ***B21D 22/20*** | (2006.01) |
| ***C21D 7/13*** | (2006.01) |
| ***C21D 8/10*** | (2006.01) |

(52) U.S. Cl.

CPC ..... *C21D 9/08* (2013.01); *B21D 22/025* (2013.01); *B21D 22/208* (2013.01); *C21D 1/673* (2013.01); *C21D 7/13* (2013.01); *C21D 8/10* (2013.01); *C21D 2211/008* (2013.01)

(58) Field of Classification Search

None

See application file for complete search history.

(56) References Cited

U.S. PATENT DOCUMENTS

| | | | | |
|---|---|---|---|---|
| 5,040,399 | A | 8/1991 | Knapper et al. | |
| 8,323,560 | B2 | 12/2012 | Satou et al. | |
| 11,021,768 | B2 * | 6/2021 | Richardson | B21D 22/025 |
| 2012/0273089 | A1 | 11/2012 | Sakkinen et al. | |
| 2016/0101456 | A1 | 4/2016 | Sikora et al. | |
| 2021/0262054 | A1 * | 8/2021 | Richardson | C21D 8/10 |

FOREIGN PATENT DOCUMENTS

| | | |
|---|---|---|
| JP | H0693339 A | 4/1994 |
| JP | 11229075 | 8/1999 |

* cited by examiner

*Primary Examiner* — Scott R Kastler

(74) *Attorney, Agent, or Firm* — Fishman Stewart PLLC

(57) ABSTRACT

A method of producing a shaped structure support, e.g., for a vehicle, is disclosed. The method includes: heating a hollow workpiece of a steel material to a material transformation temperature range; deforming the hollow workpiece in a press into the shaped structure support having a predefined complex geometry while the hollow workpiece is in the material transformation temperature range; and quenching the hollow workpiece through contact with a press tool of the press to provide the shaped structure support with a martensitic microstructure.

19 Claims, 8 Drawing Sheets

SHAPED BORON TUBULAR STRUCTURE SUPPORT

CROSS-REFERENCE TO RELATED APPLICATIONS

This application is a continuation of U.S. patent application Ser. No. 15/825,808 filed on Nov. 29, 2017, now U.S. Pat. No. 11,021,768, which claims priority to U.S. Provisional Patent Application No. 62/428,110, filed on Nov. 30, 2016, the contents of each of which are hereby incorporated by reference in its entirety.

TECHNICAL FIELD

The present disclosure relates generally to a tubular structure support and a method for its production, and more particularly to a shaped, hot formed hollow tubular structure support and a process for forming the tubular structure support into specific shapes with a martensitic microstructure.

BACKGROUND

Structure supports, such as steel tubes, are hollow structures that are used in a variety of applications. Structure supports may be produced by two distinct processes that may result in either a seamless or welded support. Raw metal, such as steel, is first cast into a workable starting form, and then is made into a structure support (e.g., a tube) by stretching the steel out into a seamless tube or forcing the edges together and sealing them with a weld.

Many industrial applications, including but not limited to vehicle frames and sub-frames, commercial and residential furniture, machinery parts, and building, infrastructural and architectural structural elements, demand high strength and lightweight tubular steel structures. As a specific example, an important aim of the automotive industry is to decrease fuel consumption by reducing the weight of the vehicle without sacrificing the structural integrity (e.g., safety) of the vehicle. It is preferred that vehicle structure supports be lightweight to provide improved fuel economy or energy savings. On the other hand, structure supports such as those applicable for vehicle sub-frames or other vehicle structural assemblies (e.g., door structures, seat structures, roof structures, floor structures, bumpers, etc.) preferably have properties of high strength to satisfy the strict standards of crash worthiness and thereby maintain the structural integrity of the vehicle. Higher-strength steel, however, leads to forming problems due to the nature of the material. Low elongation consequent to higher strength increases the risk of fracture or breakage during forming, and a higher yield stress or strength tends to cause dimensional defects such as springback. Springback is a common phenomenon in metal forming caused by elastic relocation of the internal stresses during unloading of the blank and an uneven stress distribution in a thickness direction of the blank.

Further, many industrial applications desire shaped or formed structure supports. For example, it may be desirable in the automotive industry to have a closed section structural component, such as a steel tube, bent in a particular manner for improved performance with respect to energy savings and safety requirements. A closed section structural component may retain better structural characteristics due to its overall resistance to collapse as compared to open section components (e.g., a shaped steel sheet) at certain deformation events. A closed section structural component may further provide more desirable stiffness characteristics, resistance to vibration, etc., than open section components. Some examples of structure supports in the automotive industry favoring closed section components include door beams, tower bars, floor pan stiffeners and bumper beams.

However, conventional engineering materials and devices fail to achieve these desired attributes, particularly within the context of high strength steels. Forming of high strength steels at room temperature is limited by low formability and considerable springback (e.g., elastic recovery). Cold working or cold forming processes, which are characterized by shaping a workpiece at a temperature below its recrystallization temperature and typically at ambient temperature, increases the metals strength through strain hardening. Since steel formability decreases with increasing strength, conventional cold forming processes are limited by the amount of permissible forming before facture and can only produce simple shapes. For example, conventional cold forming processes such as roll forming cannot produce transitional or varying shape sections and are generally limited to producing parts with constant profile and simple cross sectional shapes (e.g., round, square, "hat" sections, etc.). Further, shaped cold formed parts may suffer from severe springback due to their bending dominative deformation mode and high strength steel material.

The structure support may undergo a heat treatment process to alter the mechanical properties of the material. Generally, heat treatment uses phase transformation during the process to change a microstructure of the material in solid state. These phase and structural transformations may determine the overall mechanical behavior of the steel material, including properties such as strength, hardness, toughness and ductility, and consequently the implementation of the steel tube for industrial applications. A heat treatment station in conjunction with a tube mill provides a mechanism to strengthen a typical steel tube. However, such systems restrict the types of geometries that can be sufficiently processed in light of the reality that steel components are carried on rollers in the heating oven (e.g., a furnace) and while being transferred between stations, and are spun or rotated during processing. For example, a tube with an arc length (e.g., curved along the longitudinal axis) cannot be carried on rollers. As another example, a straight length tube with a square cross section cannot be spun or rotated while progressing through the heat treatment stage or transfer stage. Further, once heat treatment is complete, the steel component cannot be subsequently formed into another shape due to the increase in strength and rigidity characteristic of the thermal phase transformation. Conventional heat treated steel components may also suffer from material defects due to the elevated temperatures and inevitable exposure to aerial oxygen. As a result, rapid oxidation or scale formation and surface decarburization may occur, which leads to a poor surface finish, loss of material or reduced material utilization, and/or a weakening of the surface layer from a loss of carbon. Moreover, the springback behavior of the steel component is further complicated due to thermally induced volume inflation and stress gradients resulting from uneven cooling and/or phase transformation hardening.

Conventional hot forming processes also suffer from various drawbacks. Hot forming is a method of forming components at elevated temperatures and generally includes a furnace system and a press. The furnace system provides a mechanism to heat treat the steel component to lower its strength and thereby increase the formability of the steel material. However, similar process limitations as discussed above, e.g., carrying the steel components on rollers, restrict the types of geometries that can be sufficiently processed. The press, such as a stamping press, provides a mechanism to form the component into a desired shape. In typical hot stamp pressing techniques a steel sheet is heated to a high temperature (via a furnace system) and then formed with a die while the steel sheet is at the high temperature, whereby the steel sheet it provided with a shape and the heat treatment is completed by quenching to achieve a desired shape and strength. However, hot stamping processes cannot form closed section components such as a hollow structure support and, once a steel sheet is heat treated, it cannot then be formed into another shape owing to the strength increasing thermal phase transformation.

Overcoming these concerns would be desirable and could save the industry substantial resources.

BRIEF DESCRIPTION OF THE DRAWINGS

While the claims are not limited to a specific illustration, an appreciation of the various aspects is best gained through a discussion of various examples thereof. Although the drawings represent illustrations, the drawings are not necessarily to scale and certain features may be exaggerated to better illustrate and explain an innovative aspect of an example. Further, the exemplary illustrations described herein are not intended to be exhaustive or otherwise limiting or restricted to the precise form and configuration shown in the drawings and disclosed in the following detailed description. Exemplary illustrates are described in detail by referring to the drawings as follows:

DETAILED DESCRIPTION

Figure 1:
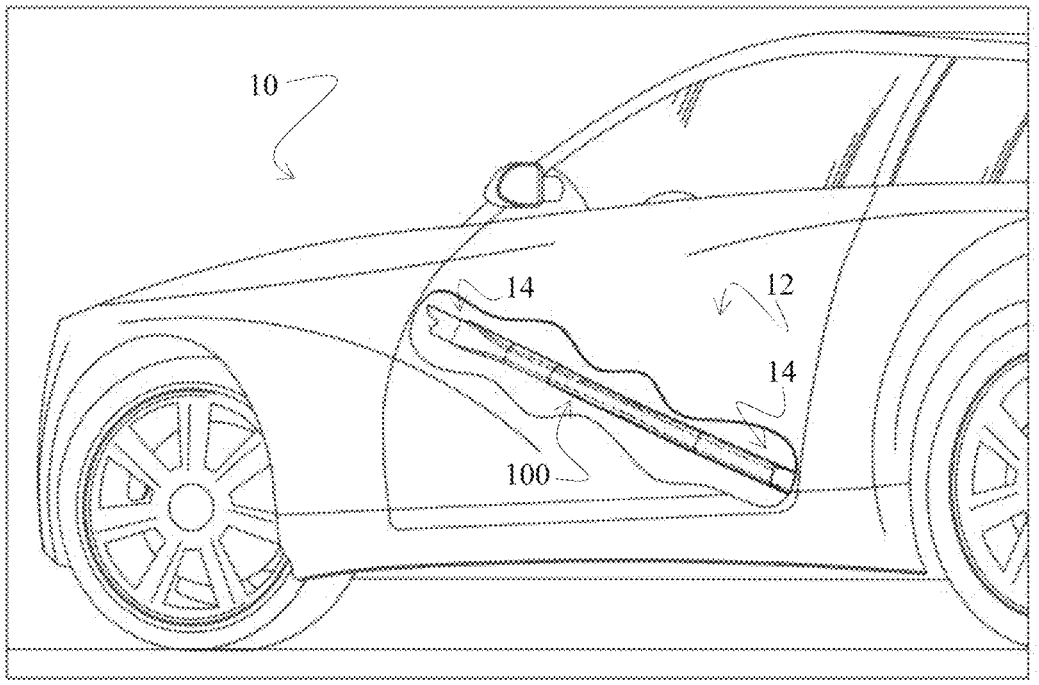
FIG. 1 illustrates a shaped structure support integrated into a vehicle structure.

In the drawings, exemplary illustrates are shown in detail. The various features of the exemplary approaches illustrated and described with reference to any one of the figures may be combined with features illustrated in one or more other figures, as it will be understood that alternative illustrations that may not be explicitly illustrated or described may be able to be produced. The combinations of features illustrated provide representative approaches for typical applications. However, various combinations and modifications of the features consistent with the teachings of the present disclosure may be desired for particular applications or implementations. Artisans may recognize similar applications or implementations with other technologies and configurations.

The following discussion is but one non-limiting example of an improved tubular structure support, for example that may be integrated into a structure of a vehicle, and a process for producing the same. It will be appreciated that the disclosed structure support may be used in various vehicle structures, such as door structures, seat structures, roof structures, floor structures, bumpers, and vehicle subframes, as well as in other structures and applications including, but not limited to, carriage frames, shelter frames (moveable and fixed), instrument panel reinforcements, carriage frames, furniture frames and residential and commercial structure frames and infrastructure. It will further be appreciated that a vehicle applies broadly to an object used for transporting people and/or goods by way of at least one of land, air, space and water.

The representative illustrations described below relate generally to a hot-formed, shaped tubular structure support and a process for producing the same. More particularly, the shaped structure support has a predefined complex geometry comprised of a steel material having a martensitic microstructure that is lightweight and cost efficient while maintaining attractive mechanical properties such as tensile strength, yield strength, hardness and elongation. The predefined complex geometry includes, but is not limited to, non-round shapes in cross section (e.g., oval, square, triangular, trapezoidal, diamond, etc.), non-linear shapes (e.g., arced, curved, stepped, swept, etc.) and/or transitional shapes (e.g., varying cross sectional shape such as oval to round, square to rectangular, etc.). Shaped structure supports formed into a predefined complex geometry with a martensitic microstructure are advantageous because non-round components, transitional shape components and/or non-linear components cannot be processed in standard heat treatment techniques such as tube mills and, once heat treated, cannot be subsequently formed into complex shapes since formability is poor due to the increase in strength characteristic of heat treated steel. Further, shaped structure supports may be beneficial because they can be tailored to specific package environments and/or predetermined installation situations (e.g., a curved oval door beam better fits the space available for a door).

According to an aspect of the disclosure, a process of producing the shaped tubular structure support includes heating a hollow, closed section workpiece composed of a steel material (e.g., a circular cylindrical hollow steel tube) to a material transformation temperature range, e.g., an austentizing temperature range, forming the hollow workpiece in a press tool into a predefined complex geometry while the workpiece is still at the material transformation temperature range and quenching the shaped hollow workpiece at a predefined cooling rate to provide the steel material with a martensitic microstructure having desired mechanical attributes. The structure support may include a tensile strength of about 1450 MPa, a yield strength of about 1150 MPa, a modulus (E-modulus) of about 175 GPa, an elongation of about 8%, and a hardness ranging from approximately 45 HRC (~450 HV) to 64 HRC (~840 HV).

The production process may be implemented as a direct hot-forming process where all of the deformation of the hot workpiece is done in a single pressing step or stroke with the result of a net or near net shape final product. At high temperatures, the material has high formability, and complex shapes can be formed in a single stroke or pressing step. This provides efficiency advantages because the workpiece or blank initially has the structure of a circular cylindrical hollow steel tube to facilitate passing the workpiece through standard tube mills and/or heat treatment systems that consist of rollers for carrying, rotating and spinning the workpiece through the production line (e.g., an oven) to the forming stage. Alternatively, it may be possible under certain circumstances to do the forming by utilizing a series of pressing steps where a preform is heated and then quenched in a press tool. Further, in certain situations it may be advantages for the forming to be completed before the beginning of the martensite transformation (e.g., before the martensite start point $M_s$ of around 425° C.). Since the deformation occurs when the workpiece is still in the material transformation temperature range or within a permissible threshold (e.g., 650 to 900° C.), the steel material is soft and has a formability that requires less force for shaping the workpiece to include a predefined complex geometry because the ductile face-centered-cubic austenite microstructure is deformed instead of the stronger body-centered-cubic ferrite microstructure found at lower temperatures. The shaped workpiece is then hardened through quenching at a controlled cooling rate by transforming the austenitic material into some fraction of martensite. With this increase in strength, it is possible to reduce the mass of the structure support and maintain satisfactory structural performance.

Pursuant to one implementation, the forming and quenching of the workpiece may be performed in the same step. For example, the heated workpiece may be transferred to a press tool, which may include at least two form hardening dies, to be formed while still in the material transformation temperature range to produce a predefined complex shape and quenched in a closed die set to produce desired martensitic properties by virtue of the relatively cooler press tool contacting and pressing the workpiece. By quenching the deformed workpiece under pressure, the phase transformation from austenite (fcc) to martensite (bct) occurs under an external stress and the transformation-induced plasticity causes irreversible deformation to provide a net shape final product in a single press step. Further, material utilization efficiencies and improved dimensional tolerances may be realized by suppressing volume inflation of the steel material that may occur during phase transformation without an externally applied stress. Optionally, the quenching may be facilitated by a quenching fluid, such as air or oil, to influence the material properties of the structure support. Additionally or alternatively, provisions may be made for internally cooling the press tool to facilitate quenching the workpiece. Accordingly, the process provides for streamlined production of formed, shaped hollow-tubular structure supports that may result in costs savings.

Referring to the drawings, wherein like numerals indicate like or corresponding parts throughout the several views, FIG. 1 shows an exemplary structure support 100 integrated into a vehicle structure 10, such as a door structure 12, although it will be appreciated that the structure support 100 may be incorporated into various structures used in various applications. The vehicle structure 10 includes a housing or frame 14 providing a predetermined installation or mounting position (hereafter "predetermined installation position") for the structure support 100 with a predefined available installation space. The structure support 100 includes a hardened steel material comprising a martensitic microstructure and a predefined complex geometry with a closed cross section. The steel material may be coated or uncoated and include a low to mid carbon content to retain formability and/or weldability with micro-alloying additions of boron. Micro-alloying additions of boron to steel are desirable as such additions improve the mechanical properties of the steel at a relatively low cost. For example, adding boron to steel may increase hardenability of the material, e.g., the ability of steel to partially or completely transform from austenite to martensite as a result of heat treatment. Additionally, boron is effective at relatively very low concentrations, providing significant improvements in hardenability at relatively low costs. The steel material may further include additional alloying elements such as manganese, chromium and/or silicon. Merely as examples, the steel material employed herein may include, but is not limited to, 15B21 steel, 22MnB5 steel, and the boron steel material described in co-owned U.S. patent application Ser. No. 14/722,861, the contents of which are hereby incorporated by reference in its entirety.

The boron steel material along with the process used to produce the structure support 100 has advantages with respect to mass, strength (e.g., yield strength and tensile strength), hardness and cost, making the structure support 100 ideal for integration into vehicles or other applications desiring lightweight supports. Mass savings may be derived from the boron material, which is effective in very low concentrations, and the strength increasing martensitic microstructure such that the structure support 100 will maintain a strength and hardness sufficient to satisfy vigorous vehicle safety requirements. With this increase in strength attributable to martensitic microstructure, it is possible to reduce the mass and thickness of the structure support 100 while at least maintaining equal structural performance.

Figure 2:
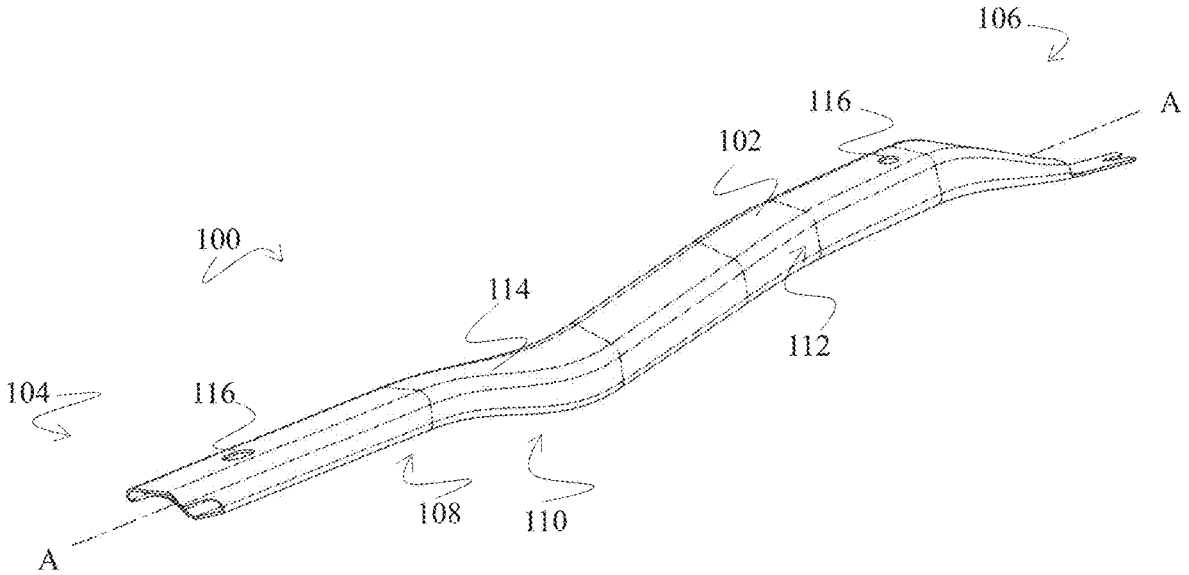
FIG. 2 illustrates a perspective view of the shaped structure support of FIG. 1 according to an example.

As shown in FIG. 2, the structure support 100 may include a closed section body 102 (hereafter "body 102") extending a predetermined length along a longitudinal axis A between a first end 104 and a second end 106. The body 102 may be welded, seamless or a combination thereof and have a hollow inner diameter extending partially or completely throughout the length along the longitudinal axis A. Additionally or alternatively, the body 102 may be monolithic (e.g., a single uniform steel material). The body 102 may be produced with the desired martensitic properties and a predefined complex geometry. In the illustrated non-limiting example, the body 102 of the structure support 100 has a generally constant cross section size (e.g., an inner cross section and an outer cross section that remains substantially constant) and a uniform wall thickness, which together facilitates a homogeneous temperature distribution and uniform cooling during quenching.

Still referring to FIG. 2, the predefined complex geometry of the structure support 100 may include a non-linear or non-straight geometry 108 (hereafter "non-linear geometry 108") along the longitudinal axis A (cf. FIG. 3B), a transitional or varying shape geometry 110 (hereafter "transitional shape geometry 110") and/or a non-round or non-circular or non-cylindrical geometry 112 (hereafter "non-round geometry 112") with respect to a cross section of the structure support 100. The transitional shape geometry 110 comprises a localized shape change which deviates from that of the surrounding or axially adjacent region(s), and thereby facilitates adapting the structure support 100 to different installation situations and/or provides local structural enhancements by adding shape and/or rigidity where desired to meet installation specific demands. The transitional shape geometry 110 may include one or more sections that have a shape deviating radially to the longitudinal axis A, such as a curvature 114. The provision of a curvature 114 in profile radially to the longitudinal axis A facilitates mounting the structure support 100 in a predetermined installation situation, and utilizes the available space more efficiently. The transitional shape geometry 110 may be arranged in, or may be more intensively pronounced in, an axially center region distal to the first and second ends 104, 106, which facilitates mounting the structure support 100 in different installation situations without having to modify the remaining regions or ends, and by providing a flat surface for mounting openings 116 to improve the connection of the structure support 100 with the frame 14 of the vehicle structure 10.

Figure 3A:
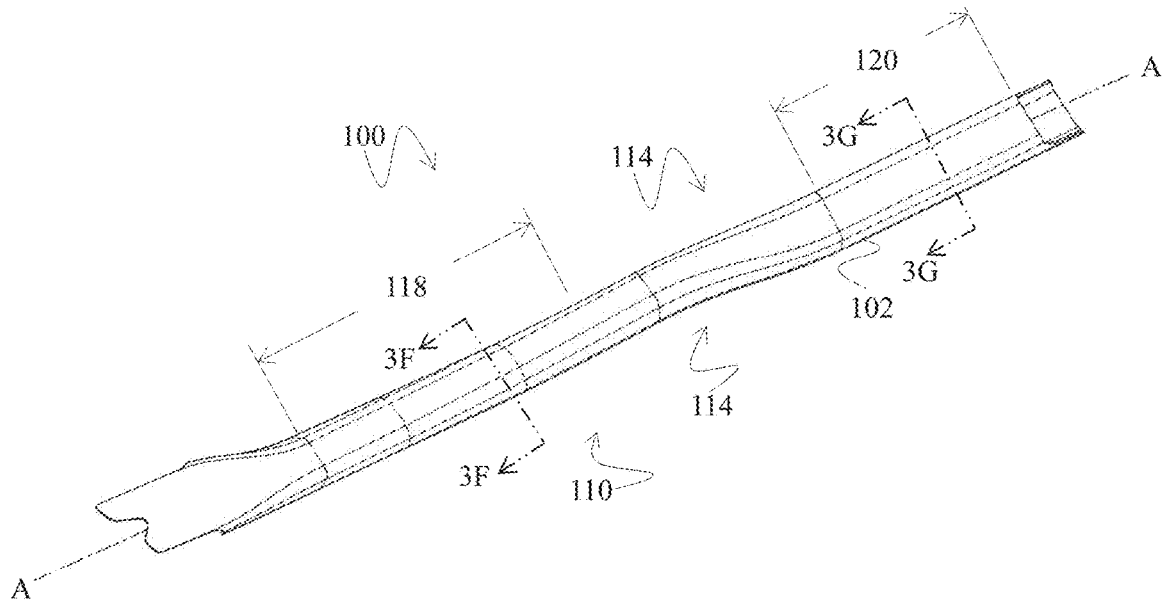
FIGS. 3A to 3G illustrate the shaped structure support of FIG. 1 according to different examples.

Additionally or alternatively, with reference to FIGS. 2 and 3A, the transitional shape geometry 110 may include one or more regions 118, 120 that has a varying shape in an axial direction along the structure support 100, e.g., one or more regions having a cross section that varies from oval to round to oval, from oval to rectangular, from rectangular to square, etc., and/or one or more regions having an outer diameter or outer cross section that varies from edged to rounded corners, for example. In the illustrated example shown in FIG. 3A, the structure support 100 has a transitional shape geometry 110 including a first region 118 with an oval cross section, a curvature 114 and a second region 120 with a rectangular 4-bar cross section. In this case, the curvature 114 gradually merges the different cross sectional shapes of the first region 118 with the second region 120, and thereby couples the disparate regions without special joining measures such as welding. Such local shape variations in the structure support 100 facilitate improvements with respect to space utilization efficiency through suitable modification to the section geometry and structural enhancement or reinforcement by adding shape/rigidity where needed.

Figure 3B:
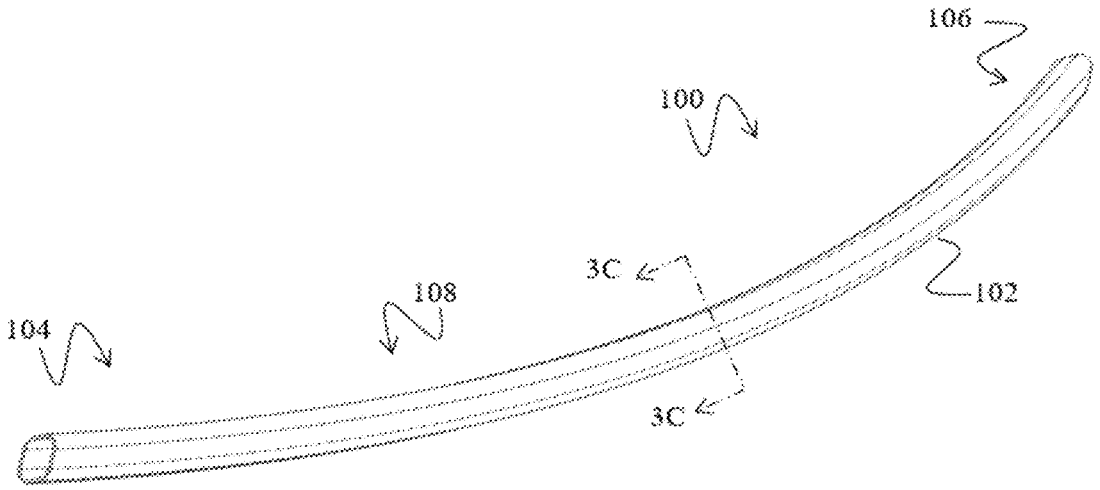
Figure 3F:
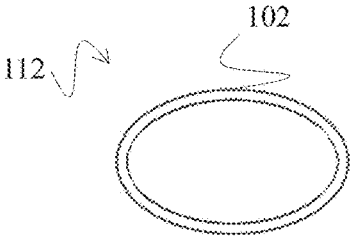
Figure 3G:
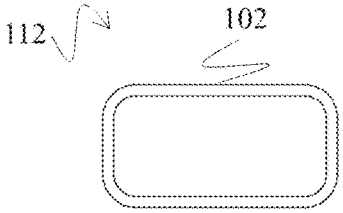
Figure 3C:
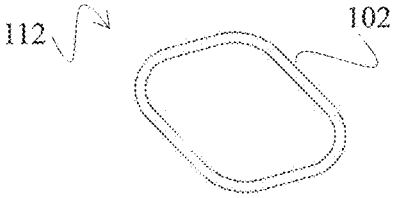
Figure 3D:
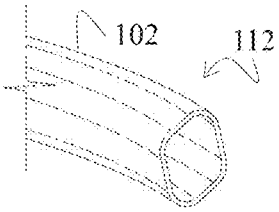
Figure 3E:
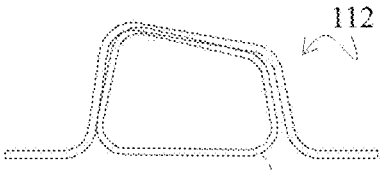

Referring to FIG. 3B, the structure support 100 may be shaped to include a non-linear geometry 108, with the non-limiting example illustrating a structure support 100 with a swept profile, or a gradual bend, along the longitudinal axis A. FIGS. 3C-3E illustrate non-limiting examples of a structure support 100 shaped to include a non-round geometry 112, with FIG. 3C showing a center cross section of the structure support 100 of FIG. 3B having rounded edges, FIG. 3D showing an oval, in particular diamond, cross section, and FIG. 3E showing a wedge-shape cross section. Combinations of a non-linear geometry 108 and a non-round geometry 112 are also contemplated, as shown by way of the 4-bar swept structure support 100 in FIGS. 3B and 3C.

By providing specific hardened shapes such as a non-linear geometry 108, a transitional shape geometry 110, and/or a non-round geometry 112, the structure support 100 can be customized to meet specific package environments and predetermined installation situations. For example, a vehicle seat structure may require a 4-bar swept structure support. Additionally, unlike conventional hot forming methods, the structure support 100 of the disclosure is shaped with a closed section along its longitudinal length, which can maintain its structural integrity longer and at higher deformation conditions. For example, a closed section structure support 100 can retain better structural characteristics than open section components such as stamped parts at certain high deformation events (e.g., crashes, impacts, blade-off events, etc.) due to its overall resistance to collapse, ability to dissipate energy, stiffness characteristics and resistance to vibrations. Accordingly, the structure support 100 may demonstrate superior structural performance and crashworthiness as compared to open section parts, for example within the context of door beans, tower bars, pillars, floor pan stiffeners, bumper beans, seat frames, and the like.

Figure 4A:
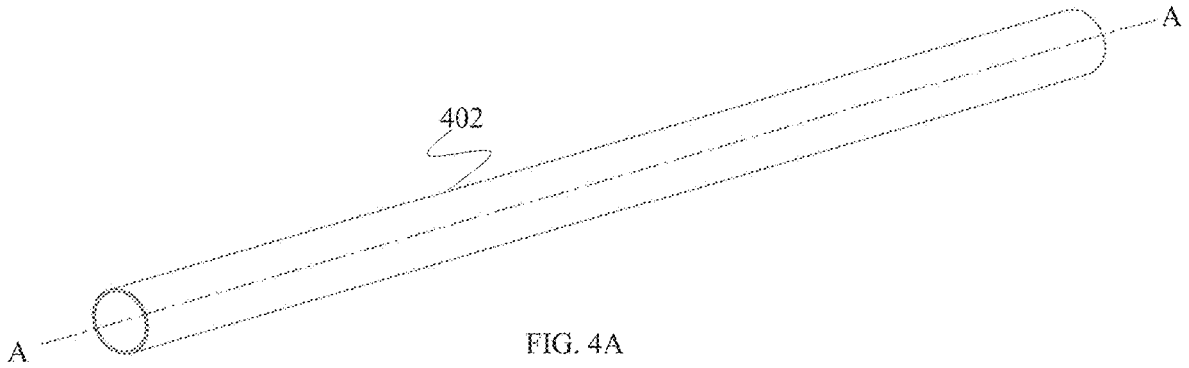
FIGS. 4A to 4C illustrates schematically a hot-forming operation utilized in a process according to the disclosure.
Figure 4B:
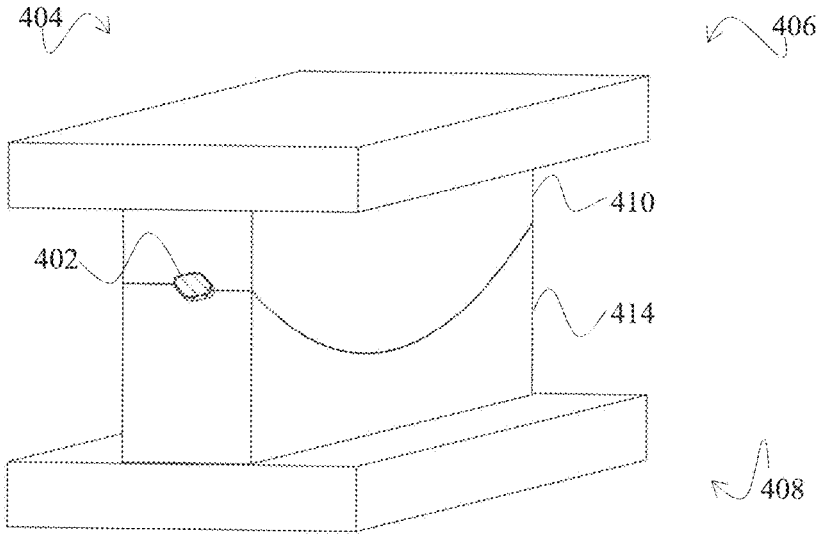
Figure 4C:
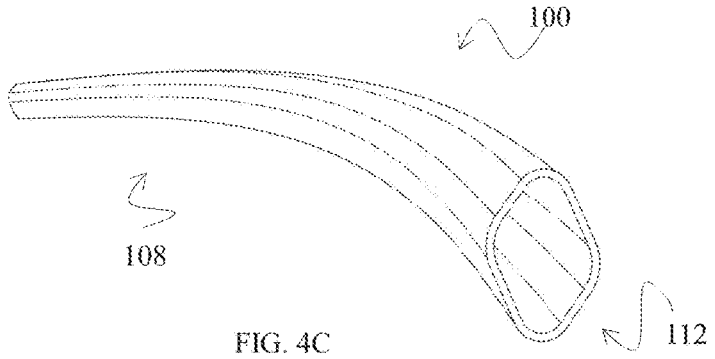

The structure support 100 may be manufactured by a process involving heating a formed/shaped workpiece to a material transformation temperature range, then forming the workpiece while still above the material transformation temperature followed by quenching at a predefined cooling rate to produce a predefined complex geometry with desired martensitic properties. FIGS. 4A to 4C show schematically a production method 400 for producing a structure support 100 according to the disclosure. As shown in FIG. 4A, a hollow, closed section workpiece 402 is provided with initial dimensional attributes such as cross section, wall thickness and length (e.g., a circular cylindrical hollow tube). The workpiece 402 is composed of a metal material, for example a boron steel such as 22MnB5. The workpiece 402 is heated in an oven (e.g., in a furnace or inductively) to a material transformation temperature range (e.g., 800° C. to 1100° C.) to austenitize the boron steel material. The heated workpiece 402 is then transferred to a press tool 404 without substantial heat loss and formed in the press tool 404 while still in the material transformation temperature range, as shown in FIG. 4B. The workpiece 402 is quenched in the press tool 404 at a predefined cooling rate to produce a structure support 100 with a predefined complex geometry and desired martensitic properties, as shown in 4C. In the example shown, the structure support 100 is formed with a non-linear 108 (e.g., a swept profile) and a non-round geometry 112 (e.g., a diamond shape cross section).

Figure 5:
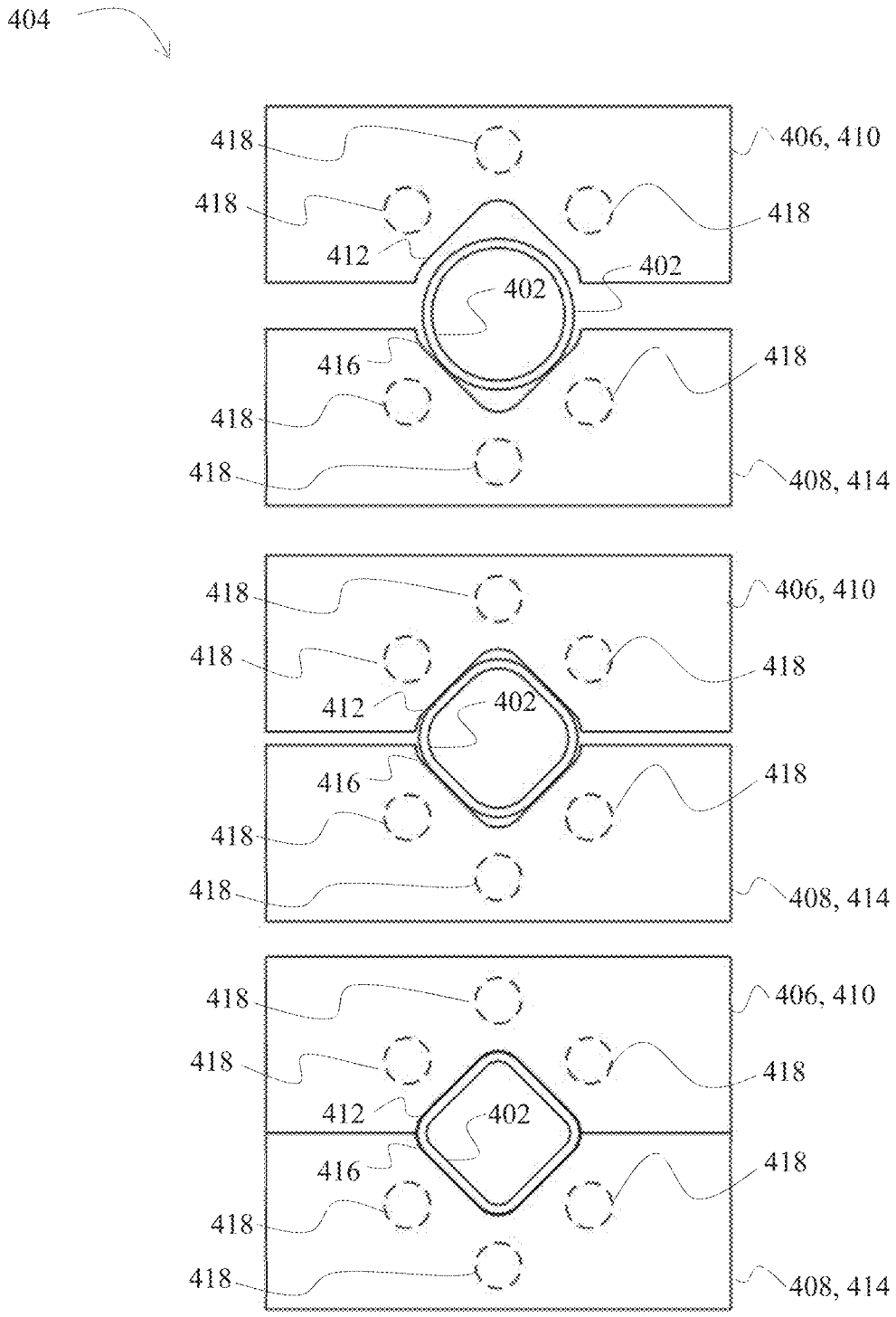
FIG. 5 is a schematic cross-sectional view of a press tool according to FIG. 4B.

With reference to FIGS. 4B and 5, the press tool 404 may include one or more form hardening dies to shape the workpiece 402 into a structure support 100 with a predefined complex geometry. The press tool 404 includes a first tool 406 and a second tool 408 movable relative to one another. The first tool 406 includes a first die 410 having a first cavity 412 and the second tool 408 includes a second die 414 having a second cavity 416. The first die 410 and the second die 414 may be formed integrally with the first tool 406 and the second tool 408, or may be provided as separate components. The first cavity 412 and the second cavity 416 are countered to shape the workpiece 402 into a predefined complex geometry, e.g., a non-linear geometry 108, a transitional shape geometry 110, and/or a non-round geometry 112. The first cavity 412 of the first tool 406 and the second cavity 416 of the second tool 408 may be formed symmetrical to one another (e.g., the first cavity 412 of the first tool 406 is a mirror image of the second cavity 416 of the second tool 408), or the first cavity 412 of the first tool 406 may be formed asymmetrical to the second cavity 416 of the second tool 408 (e.g., an oval cavity and an edged or squared cavity). According to the non-limiting example shown in FIGS. 4B and 5, the workpiece 402 is arranged between the first tool 406 and the second tool 408, then the first tool 406 and the second tool 408 are moved towards one another to press the workpiece 402 with a controlled, predetermined force until the first and second tools 406 and 408 are at an end position to form the workpiece 402 into a predefined complex geometry. By controlling the force applied against the workpiece 402 during the pressing stroke or movement of the first and second tools 406, 408, buckling or collapse of the hollow workpiece 402 is avoided or at least reduced. For the pressing stroke, both the first tool 406 and the second tool 408 may be moved simultaneously towards one another, or the first tool 406 may be moveable and the second tool 408 is stationary, or vice versa. In the end position, the press tool 404 maintains a controlled pressing force so that the first tool 406 and the second tool 408 continue to apply pressure on the workpiece 402. At the same time, the first and second tools 406 and 408 may quench the workpiece 402 through contact by the relatively cooler cavities 412, 416, which quenching may be facilitated by a quenching fluid such as a gas (e.g., air, nitrogen, etc.), water and/or oil. Once the workpiece 402 has cooled after a predetermined duration, the first tool 406 and the second tool 408 separate or otherwise move apart.

Pursuant to the above-described implementation, the press tool 404 may function as a direct hot-form, contact die/quench tool where all of the deformation of the workpiece 402 is done in a single pressing stroke and in the high temperature austenitic range followed by quenching through contact with the first and second tools 406 and 408. Forming the workpiece 402 into a net or near net shape product together with closed die quenching proves advantageous with respect to avoiding springback and other dimensional defects due to the externally applied pressure from the first and second tools 406 and 408 during the microstructure phase change. Alternatively, it may be possible under certain circumstances to do the forming by utilizing a series of pressing steps where a preform is heated and then quenched in a press tool. The first tool 406 and the second tool 408 may contact the entire surface of the workpiece 402 during quenching and quench the workpiece 402 uniformly at a predefined cooling rate, e.g., a rate of about 27° C./second or greater, to facilitate a homogeneous temperature distribution and uniform cooling. According to another example, the first tool 406 and/or the second tool 408 may be configured to quench one or more regions the workpiece 402 at a different cooling rate than one or more other regions to provide certain sections with selective strength characteristics by forming a desired microstructure (e.g., martensite) in a region of the workpiece 402 that is different than the microstructure in another region. For example, a first region of the workpiece 402 may be quenched at a cooling rate greater than about 27° C./second, while a second region may be quenched at a cooling rate less than about 27° C./second or greater than 50° C./second, merely as examples, so that the first region is cooled at a different rate than the second region. The first tool 406 and/or the second tool 408 may include one or more flow passages 418, shown in dashed lines, for internal cooling by using a heat transfer fluid such as air, water, quenching oil, or the like to flow through in a desired amount to influence the cooling of the workpiece 402, and the flow passage 418 may be controlled by a control device such as a valve (e.g., a proportional valve).

Figure 6:
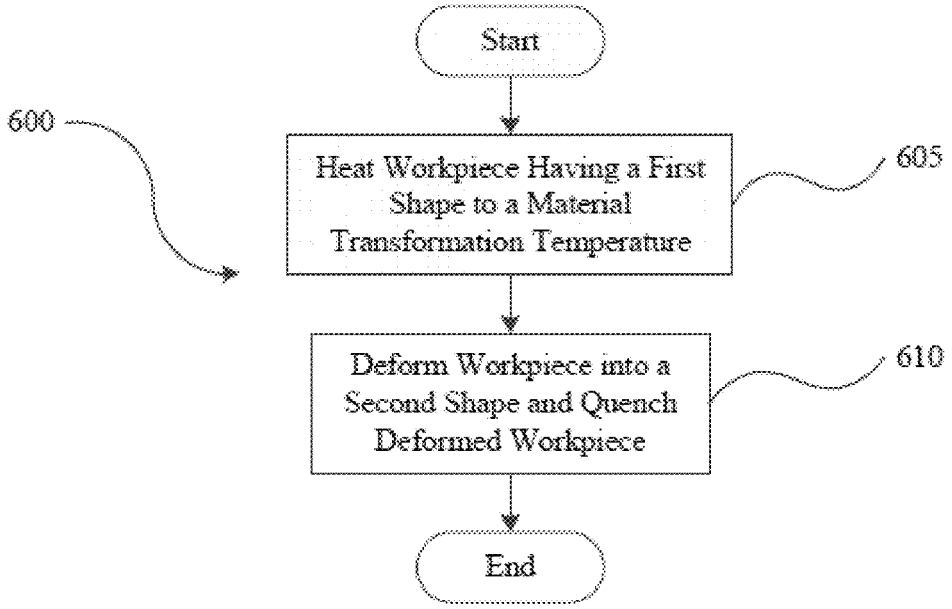
FIG. 6 is a flow chart illustrating an exemplary process for forming a structure support according to an aspect of the disclosure.

FIG. 6 is a flowchart showing a representative process 600 for manufacturing a structure support according to one aspect of the disclosure. At operation 605, a closed section hollow steel workpiece having a first shape with predefined dimensional attributes is heated to a material transformation temperature range, e.g., an austenitic temperature range. In this operation, the workpiece is heated to a temperature of at least 800° C., and generally to about 900° C. to about 1100° C. for several minutes. At the austenitic temperature range, the steel material is very ductile and more easily formed into complex shapes. The heating duration may depend on factors such as steel composition, wall thickness and/or desired mechanical properties, but generally lasts for approximately 300 seconds to 600 seconds. Heating the workpiece for a longer soak time such as 520 seconds may result in less decarburization, slightly higher hardness and/or a more uniform through-hardness transverse to the longitudinal axis A (e.g., less hardness variance throughout the cross section). Decarburization may be further reduced by using a coated steel material such as 22MnB5 steel.

At operation 610, the workpiece is deformed into a second shape, e.g., a predefined complex geometry, while the workpiece is still in the austenitic temperature range and quenched to provide the steel material with a desired martensitic microstructure. Operation 610 may be performed as a so-called direct hot-forming operation where the workpiece is formed and quenched in a closed die set of a press tool, as described above. The quenching may be performed via direct contact of the workpiece with the cavities of the press tool, and may be facilitated by a quenching fluid such as by purging the inner diameter of the workpiece with air. The forming and quenching of the workpiece may be performed in an inert atmosphere (e.g., argon gas and/or nitrogen gas) to further reduce decarburization and scale formation. The workpiece may be cooled at a rate of greater than 27° C. per second to achieve a desired martensitic microstructure, wherein a cooling rate approaching 100° C./second or greater forms a predominately martensitic microstructure and achieves higher strength and hardness values. The hardened and shaped structure support may include one or more of the following properties: a tensile strength of approximately 1300 to 1600 MPa; a yield strength of approximately 1000 to 1200 MPa; an elongation, or a change in length before fracture, of approximately 5% to 10%; and a hardness in the range of about 45 HRC to 64 HRC.

After operation 610, a net or near net shape (e.g., final) structure support is produced, which may undergo a further treatment step such as tempering to increase the formability of the structure support. Tempering may transform some of the brittle martensite into tempered martensite and reduce excess hardness of the steel material. The tempering treatment may include heating the structure support to a temperature below the austenitizing temperature (e.g., at a temperature of about 100° C. to 450° C.) and cooling the structure support (e.g., allowing the workpiece to cool under ambient/still conditions, re-quenching the workpiece at a predefined cooling rate using a fluid such as air, nitrogen, oil, water, or a combination thereof).

By deforming the workpiece while still in the material transformation temperature range (e.g., in the austenitic range) and quenching in a closed die set, the springback effect is avoided or at least reduced by suppressing volume inflation of the material through an externally applied force. As such, tighter tolerances, greater material utilization and improved fatigue resistance can be achieved than in conventional heat treatment and hot forming techniques. The formation of martensite may further be facilitated by forming the heated workpiece without substantial heat loss after transferring the workpiece from the oven to the press tool. If the temperature of the workpiece falls too far before die quenching or too slowly in the die quench process, the resulting microstructure may include some fraction of bainite and/or ferrite that may be undesirable in certain applications. Further, the formability of the steel material is severely reduced if the workpiece is cooled to a temperature that forms martensite prior to being deformed. According to an implementation, the deformation and shaping of the workpiece into a predefined complex geometry is completed before the beginning of the martensite transformation (e.g., before the martensite start point $M_s$ of around 425° C.). In this regard, it may be desirable for the transfer time from operation 605 to operation 610 to occur within about 60 seconds, and preferably within a duration of about 15 to 30 seconds.

Figure 7:
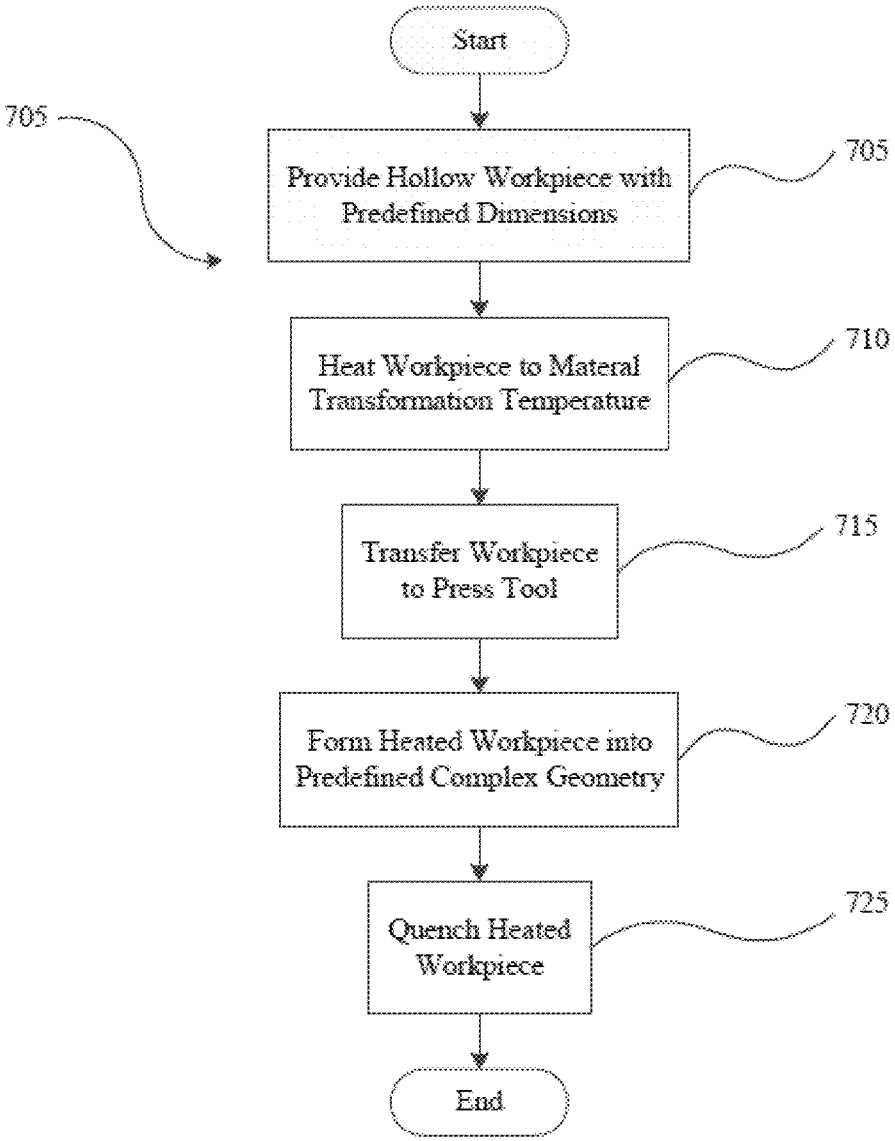
FIG. 7 is a flow chart illustrating an exemplary process for forming a structure support according to another aspect of the disclosure.

FIG. 7 is a flow chart showing a representative process 700 for producing a structure support according to another aspect of the disclosure. The process starts at block 705 by providing a hollow workpiece with predefined dimensional attributes (e.g., thickness, width, inner diameter, outer diameter, shape, etc.). The workpiece may be composed of low-alloy steel that may include carbon, boron, manganese and chromium. The workpiece may initially comprise a circular-cylindrical hollow steel tube, although pre-formed and/or partially shaped steel components are also contemplated within the scope of this disclosure.

At block 710, the workpiece may be heated to a material transformation (e.g., austenitizing) temperature range for a predetermined duration to austenitize the steel composition. Exemplary austenitizing temperatures may range from about 800° C. to 1100° C. The predetermined duration may last until substantially all of the ferrite is transformed into austenite, which may include a soak time of around 300 seconds to 600 seconds, merely as examples.

Figure 8:
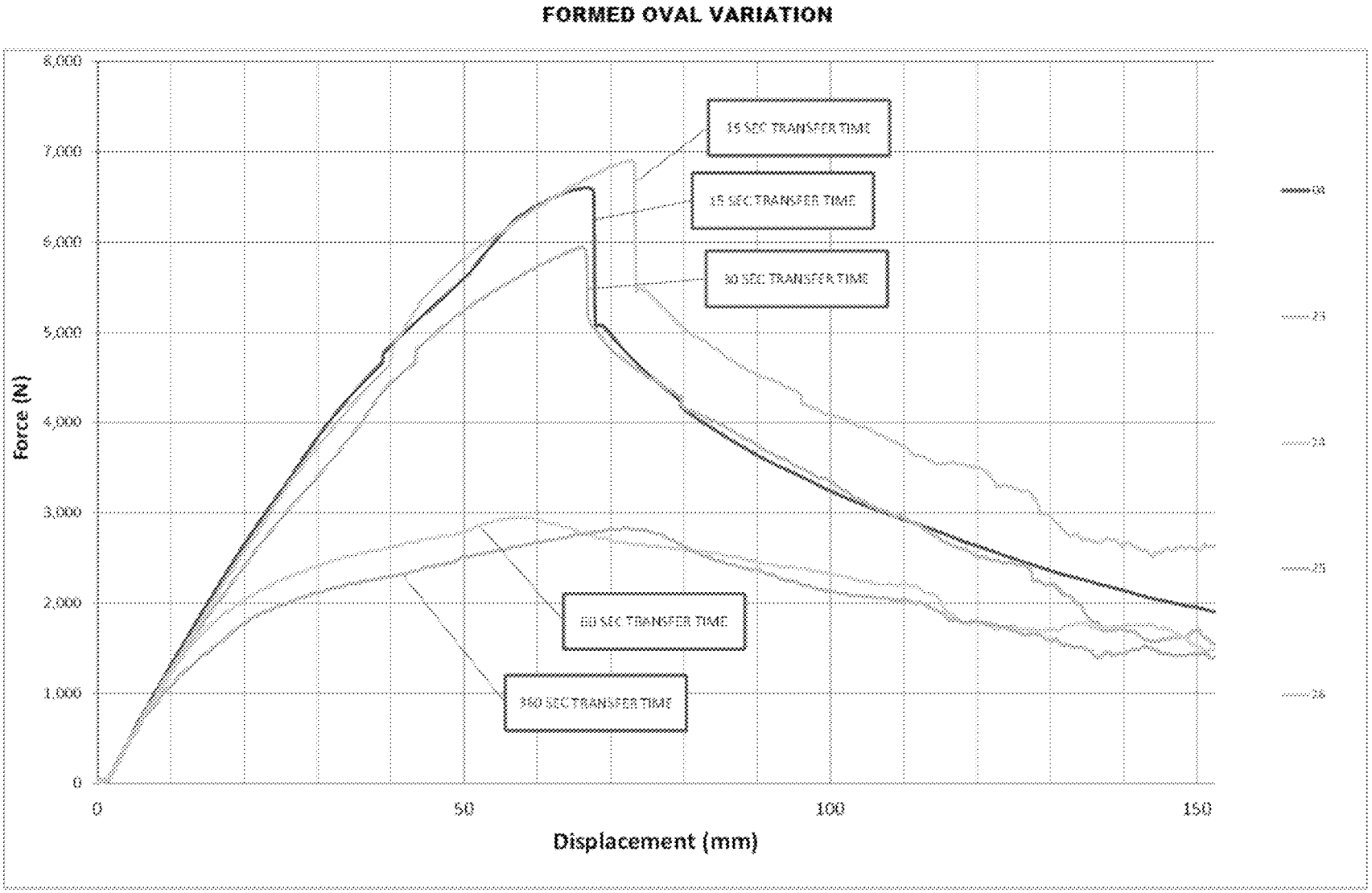
FIG. 8 is a graph illustrating the transfer time for retaining the heat treatability of the heated structure support.

At block 715, the heated workpiece is transferred from the heating system (e.g., a furnace, a conduction system or an inductive system) to a press tool for subsequent forming within a specified time period. Generally, to form a martensitic microstructure within a region of steel in an austenite phase, the workpiece should be transferred to the press tool in under 60 seconds, for example within 30 seconds or less. Test results have showed that the hot workpiece retained its heat treatability temperature after leaving the oven up to 30 seconds, but not after 60 seconds, as shown in FIG. 8. As illustrated in FIG. 8, a heated workpiece transferred to the press tool from the furnace within thirty (30) seconds was shown to be martensitic. In contrast, a workpiece formed in the press tool sixty (60) seconds after leaving the furnace was not martensitic. Accordingly, the specified time period for transferring the workpiece from the oven to be formed in the press tool should be less than 60 seconds, in particular 30 seconds or less (e.g., 15 to 30 seconds), and in some circumstances 15 seconds or less, to produce a martensitic microstructure in the end material of the structural support. Further, shorter transfer times reduce the amount of exposure with oxygen and results in less decarburization and scale formation.

After the workpiece is transferred from the oven to the press tool, the workpiece is formed while still in the material transformation temperature range into a desired shape at block 720. The press tool deforms the workpiece into a predefined complex geometry that shapes the resulting structure support into at least one of a non-linear geometry, a transitional shape geometry, and a non-round geometry. Further, all of the deformation of the workpiece may be performed in a single pressing stroke or movement, and may be completed before the beginning of the martensite transformation temperature.

At block 725, the workpiece is quenched to produce a martensitic microstructure and provide desired mechanical properties such as hardness, tensile and yield strength, and elongation. The cooling rate may range from about 27° C./second to about 100° C./second, and in some circumstances from around 50° C./second to 100° C./second, to form a desired amount of martensite, depending on the steel composition. The workpiece may be quenched through contact with an ambient temperature form hardening die (e.g., the first and second tool) of the press tool as a contact quench. That is, the workpiece may be quenched or cooled by holding the workpiece between the first press tool or die and the second press tool or die until the austenitic microstructure transforms into the desired martensitic microstructure. Additionally or alternatively, the dies of the press tool may be internally cooled through one or more flow passages to facilitate heat transfer between the workpiece and the press tool. Additionally or alternatively, a quenching fluid may be utilized to control the rate of cooling, where the quenching fluid such as a gas (e.g., nitrogen) or fluid (e.g., water or oil) purges the inner diameter of the workpiece. Additionally or alternatively, the quenching may be performed under an inert atmosphere, such as a nitrogen gas, to reduce decarburization and scale formation. Varying the cooling rate and/or quench parameters may influence the microstructure and mechanical properties of the structure support. For example, near surface hardness was least influenced by decarburization when a quenching fluid was used in addition to the contact die quenching of the press tool. As another example, varying the soak time and quench parameters may influence the cross sectional hardness of the structure support, e.g., a soak time of 520 seconds provides a hardness of approx. 470 HV while a soak time of 420 seconds provides a hardness of approx. 450 HV.

Pursuant to one implementation, the structure support 100 produced according to the processes 600, 700 described herein forms a microstructure of predominantly martensite with trace amounts of non-martensitic transformation products, e.g., at least approximately 95% martensite. Further, the structure support 100 may generally include a tensile strength of approximately 1,200 to 1,600 MPa, a yield strength of approximately 1,000 to 1,300 MPa, an elongation of approximately 5% to 15%, and a hardness in the range of about 45 HRC (~450 HV) to 64 HRC (~840 HV).

It will be appreciated that the aforementioned methods, processes and/or steel component may be modified to have some components and steps removed, or may have additional components and steps added, all of which are deemed to be within the spirit of the present disclosure. For example, it is contemplated that the structure support 100 may be symmetrical about one or more axes, asymmetrical about one or more axes, or a combination thereof. Additionally, it is contemplated that the process may be performed by heating the workpiece directly in the press tool and then forming the workpiece in the press tool. Further, although the processes described herein utilize a press tool or a pressing step without an inner tool (e.g., a mandrel) supporting the hollow workpiece, it is contemplated that in certain situations an inner tool such as a mandrel may be used together with the press tool for supporting the inner diameter of the workpiece. Additionally or alternatively, the process may include additional steps, such as a tempering treatment and/or a machining operation performed after quenching. For example, the workpiece/steel component may be tempered by reheating and then cooling using a fluid such as air, nitrogen, water, oil or the like.

Accordingly, even though the present disclosure has been described in detail with reference to specific examples, it will be appreciated that the various modifications and changes can be made to these examples without departing from the scope of the present disclosure as set forth in the claims. It is anticipated and intended that future developments will occur in the technologies discussed herein, and that the disclosed method, device and/or article will be incorporated into such future developments. Thus, the specification and the drawings are to be regarded as an illustrative thought instead of merely restrictive thought.

All terms used in the claims are intended to be given their broadest reasonable constructions and their ordinary meanings as understood by those knowledgeable in the technologies described herein unless an explicit indication to the contrary in made herein. In particular, use of the singular articles such as "a," "the," "said," etc. should be read to recite one or more of the indicated elements unless a claim recites an explicit limitation to the contrary. Further, the use of "at least one of" is intended to be inclusive, analogous to the term and/or. Additionally, use of adjectives such as first, second, etc. should be read to be interchangeable unless a claim recites an explicit limitation to the contrary.

What is claimed is:

1. A method of producing a boron steel material shaped structure support, comprising:

heating a hollow workpiece to a material transformation temperature range to provide the hollow workpiece with an austenitic microstructure;

deforming the hollow workpiece in a press into the shaped structure support having a predefined complex geometry while the hollow workpiece is in the material transformation temperature range;

quenching the hollow workpiece through contact with a press tool of the press to provide the shaped structure support with a martensitic microstructure; and tempering the shaped structure support.

2. The method of claim 1, wherein the deforming and the quenching are performed in the same step.

3. The method of claim 2, wherein the deforming includes pressing the hollow workpiece between a first press tool and a second press tool, and the quenching includes maintaining the pressing of the hollow workpiece in a closed die set between the first press tool and the second press tool.

4. The method of claim 1, wherein all of the deformation of the hollow workpiece is done in a single press stroke of the press and is completed before reaching a martensite start temperature of the hollow workpiece.

5. The method of claim 1, wherein quenching the hollow workpiece includes pressing and holding the hollow workpiece under pressure between a first die and a second die for a predetermined duration.

6. The method of claim 1, wherein quenching the hollow workpiece further includes purging an inner diameter of the hollow workpiece with a quenching fluid.

7. The method of claim 1, further comprising transferring the hollow workpiece to the press within a predefined duration after heating the hollow workpiece to the material transformation range.

8. The method of claim 7, wherein the predefined duration is 30 seconds or less.

9. The method of claim 1, wherein the predefined complex geometry includes at least one of a non-round cross section, a transitional shape geometry, and a non-linear geometry along a longitudinal axis of the hollow workpiece.

10. The method of claim 1, wherein the shaped structure support has at least one of the following properties:

a tensile strength of about 1,200 MPa to 1,600 MPa;

a yield strength of about 1,000 MPa to 1,300 MPa;

an elongation of about 5% to 15%; and a hardness of about 45 HRC to 64 HRC.

11. The method of claim 1, wherein the hollow workpiece is quenched at a cooling rate of 27° C./second or greater.

12. A method of producing a shaped structure support for a vehicle, comprising:

providing a hollow workpiece of a boron steel material with a circular cylindrical shape;

heating the hollow workpiece to a material transformation range to provide the boron steel material with an austenitic microstructure;

forming the hollow workpiece into the shaped structure support having a predefined complex geometry by deforming the hollow workpiece in a press while the hollow workpiece is still in the material transformation temperature range;

quenching the hollow workpiece in the press to provide the shaped structure support with a martensitic microstructure;

wherein forming the hollow workpiece and quenching the hollow workpiece are performed in the same step where the hollow workpiece is pressed and held in a closed die set between a first die and a second die of the press.

13. The method of claim 12, wherein at least one of the first die and the second die includes an ambient temperature form hardening die that quenches the hollow workpiece through direct contact with a cavity of the form hardening die.

14. The method of claim 12, further comprising transferring the hollow workpiece to the press within a specified time period after heating the hollow workpiece to the material transformation temperature range.

15. The method of claim 14, wherein the specified time period is 30 seconds or less.

16. The method of claim 12, wherein quenching the hollow workpiece further includes purging an inner diameter of the hollow workpiece with a quenching fluid.

17. The method of claim 16, wherein the quenching fluid is water or oil.

18. The method of claim 12, wherein at least one of the first die and the second die includes flow passages for circulating a heat transfer fluid to facilitate quenching the hollow workpiece.

19. A method of producing a boron steel material shaped structure support, comprising:

heating a hollow workpiece to a material transformation temperature range to provide the hollow workpiece with an austenitic microstructure;

deforming the hollow workpiece in a press into the shaped structure support having a predefined complex geometry while the hollow workpiece is in the material transformation temperature range;

quenching the hollow workpiece through contact with a press tool of the press to provide the shaped structure support with a martensitic microstructure; and wherein the hollow workpiece is quenched at a cooling rate of 27° C./second or greater.

* * * * *